US006481315B1

(12) United States Patent
Chang et al.

(10) Patent No.: US 6,481,315 B1
(45) Date of Patent: Nov. 19, 2002

(54) BOX AND RATCHET WHEEL ARRANGEMENT FOR WRENCH

(76) Inventors: Sung-Hsiao Chang, 3F, No. 17, Lane 355, Sec. 3, An Kang, Rd., Shing-Tien City, Taipei Hsien (TW); Wu-Lung Chu, No. 6, 20 th Rd., Ta Li Industrial Zone, Ta Li City, Tai Chung Hsien (TW)

( * ) Notice: Subject to any disclaimer, the term of this patent is extended or adjusted under 35 U.S.C. 154(b) by 0 days.

(21) Appl. No.: 10/025,252

(22) Filed: Dec. 17, 2001

(51) Int. Cl.[7] ..... B25B 13/46
(52) U.S. Cl. ..... 81/60; 81/125
(58) Field of Search ..... 81/58, 59.1, 60–63.2, 81/125; 279/79

(56) References Cited

U.S. PATENT DOCUMENTS 2,805,594 A * 9/1957 Fogel ..... 81/125
4,259,883 A * 4/1981 Carlson ..... 81/60
5,848,561 A * 12/1998 Hsieh ..... 81/125

* cited by examiner

*Primary Examiner*—D. S. Meislin
(74) *Attorney, Agent, or Firm*—Pro-Techtor International Services

(57) ABSTRACT

A box and ratchet wheel arrangement includes a wrench body with a box at one end, a ratchet wheel mounted in the box and adapted to hold the workpiece in a serrated center coupling hole thereof, a stop block mounted in the box and forced by a spring member to engage the ratchet wheel and to control the direction of rotation of the ratchet wheel, and a retainer ring of resilient metal mounted in an outside annular groove of the ratchet wheel, the retainer ring having a plurality of protruded retaining portions inserted through respective radially extended through hole of the ratchet wheel and adapted to hold down the workpiece in the serrated center coupling hole of the ratchet wheel.

3 Claims, 5 Drawing Sheets

BOX AND RATCHET WHEEL ARRANGEMENT FOR WRENCH

BACKGROUND OF THE INVENTION

The present invention relates to wrenches, and more specifically, to a box and ratchet wheel arrangement for wrench, which is easy to install and, can positively secure the workpiece to the ratchet wheel.

A regular socket wrench has a box at one end adapted to hold a socket for grasping and turning a bolt or nut. In order to positively secure the hexagonal coupling head of the socket in the hexagonal coupling hole of the box, a holding down arrangement is provided. As illustrated in FIG. 5, the box of the wrench has steel balls arranged around the hexagonal coupling and supported on a respective spring member, and the hexagonal coupling head of the socket has a rounded recess in each of the six peripheral sidewalls for engagement with the steel balls in the box of the wrench. This design is functional. However, the complicated processing procedure of making holes in the box of the wrench for the spring members and the steel balls greatly increases the manufacturing cost of the wrench. Further, the installation of the spring members and the steel balls requires much labor.

SUMMARY OF THE INVENTION

The present invention has been accomplished to provide a box and ratchet wheel arrangement, which eliminates the aforesaid drawbacks. It is one object of the present invention to provide a box and ratchet wheel arrangement, which simplifies the fabrication of the wrench, and enables the workpiece to be positively secured to the ratchet wheel of the wrench. To achieve these and other objects of the present invention, the box and ratchet wheel arrangement comprises a wrench body with a box at one end, a ratchet wheel mounted in the box and adapted to hold the workpiece in a serrated center coupling hole thereof, a stop block mounted in the box and forced by a spring member to engage the ratchet wheel and to control the direction of rotation of the ratchet wheel, and a retainer ring of resilient metal mounted in an outside annular groove of the ratchet wheel, the retainer ring having a plurality of protruded retaining portions inserted through respective radially extended through hole of the ratchet wheel and adapted to hold down the workpiece in the serrated center coupling hole of the ratchet wheel.

DESCRIPTION OF THE PREFERRED EMBODIMENT

Figure 1:
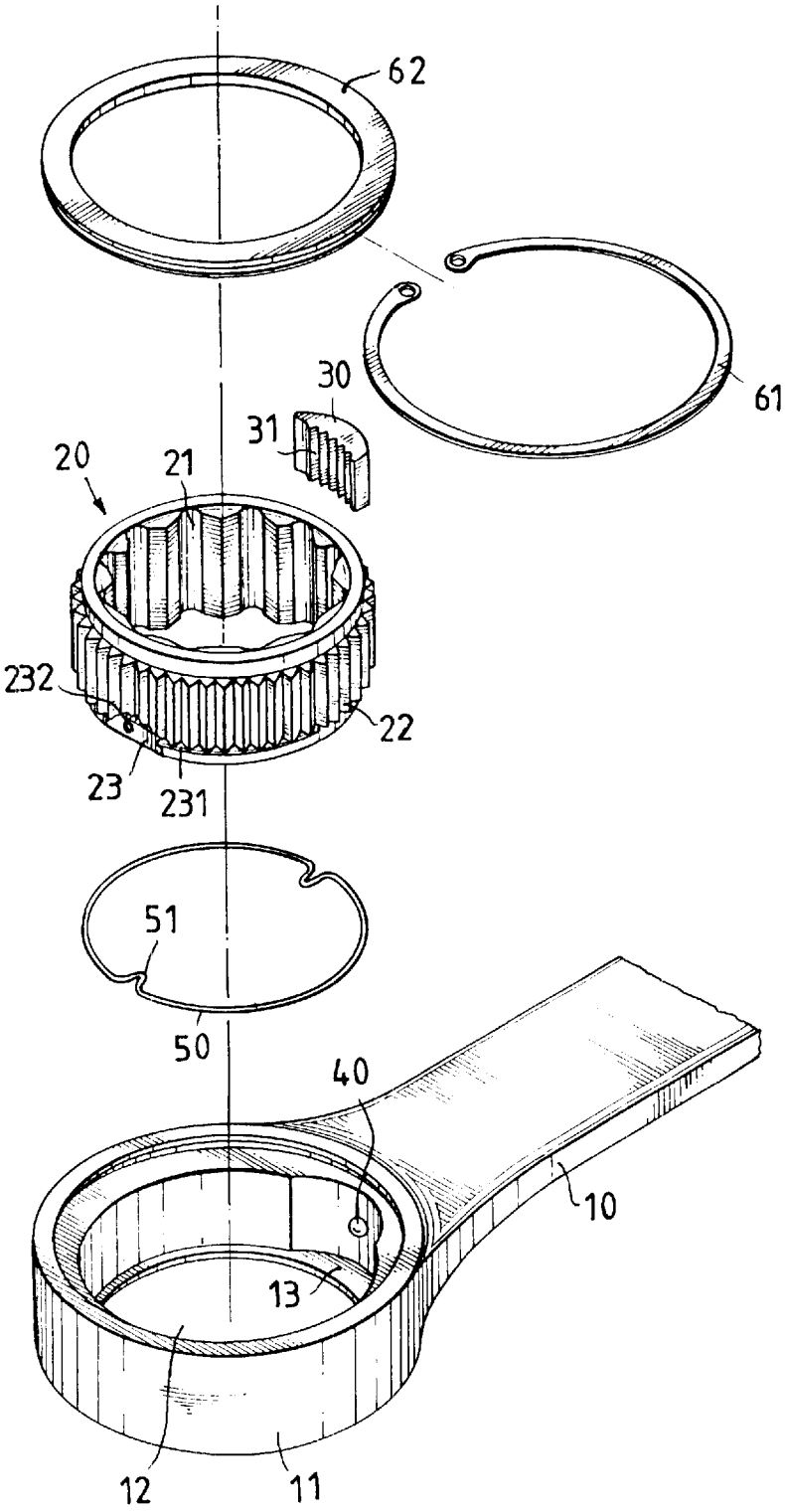
FIG. 1 is an exploded view of a box and ratchet wheel arrangement for wrench according to the present invention.
Figure 2:
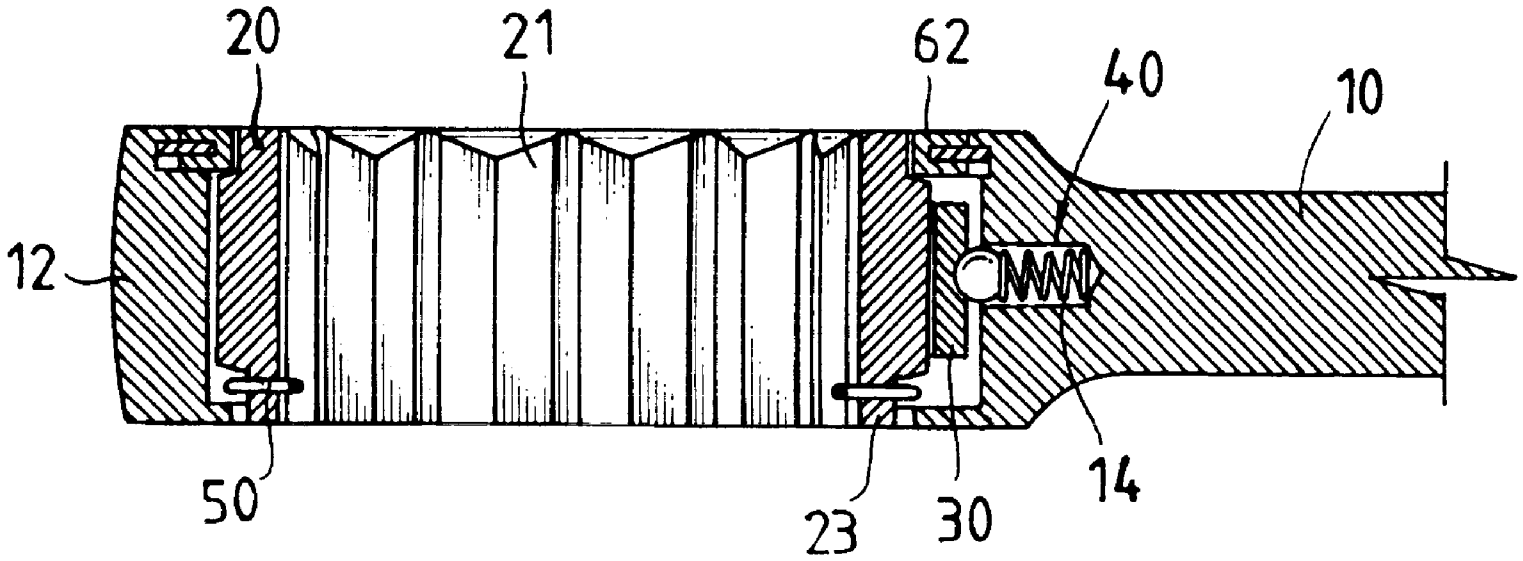
FIG. 2 is a sectional assembly view of the box and ratchet wheel arrangement for wrench according to the present invention.

Referring to FIGS. from 1 through 3, the invention comprises a wrench body 10, a ratchet wheel 20, a stop block 30, a spring member 40, and retainer means' 50.

The wrench body 10 has a circular box 11 at one end. The circular box 11 comprises on the inside a circular receiving open chamber 12, a recess 13 at one side of the circular receiving open chamber 12, and a blind hole 14 in the recess 13. The ratchet wheel 20 and the stop block 30 and the spring member 40 are respectively set in the circular receiving open chamber 12 and the recess 13 and the blind hole 14 inside the circular box 11 of the wrench body 10. An annular cover plate 62 is covered on the box 11 and secured in place by a C-shaped clamp 61 to hold the ratchet wheel 20, the stop block 30, and the spring member 40 in place.

The ratchet wheel is an annular member comprising a serrated center coupling hole 21 adapted to hold a socket, bolt, or nut, a series of peripheral teeth .22 arranged around the periphery and sloping in one direction for engagement with the stop block 30, a protruded portion 23 axially extended from a bottom side thereof, an outside locating groove 231 extended around the periphery of the protruded portion 23, and a plurality of through holes 232 radially extended through the outside locating groove 231.

The stop block 30 is mounted in the recess 13 inside the box 11 of the wrench body 10 and supported on the spring member 40, having a toothed engagement face 31 meshed with the sloping teeth 22 of the ratchet wheel 20 and adapted to control one-way rotation of the ratchet wheel 20 in the box 11 of the wrench body 10.

The spring member 40 is mounted in the blind hole 14 and stopped against the stop block 30 to force the stop block 30 into engagement with the sloping teeth 22 of the ratchet wheel 20.

The retainer means 50 is an: annular member of resilient metal mounted in the outside locating groove 231 of the protruded portion 23 of the ratchet wheel 20, having a plurality of protruded retaining portion 51 respectively inserted through the through holes 232 of the ratchet wheel 20 and partially projecting into the serrated center coupling hole 21 of the ratchet wheel 20 for securing a socket, bolt, or nut in the. serrated center coupling hole 21 of the ratchet wheel 20.

Figure 4:
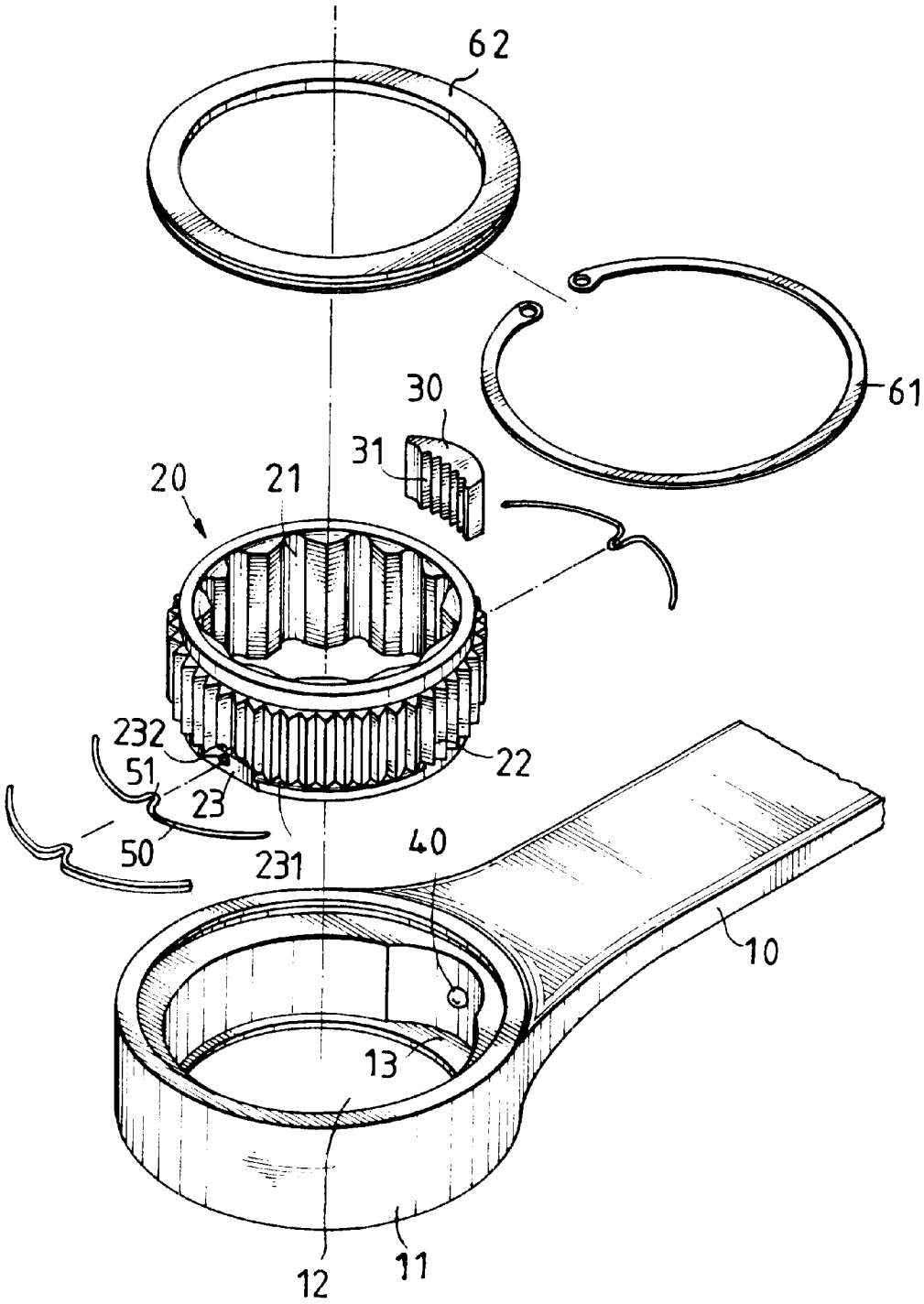
FIG. 4 is an exploded view of an alternate form of the box and ratchet wheel arrangement for wrench according to the present invention.
Figure 5:
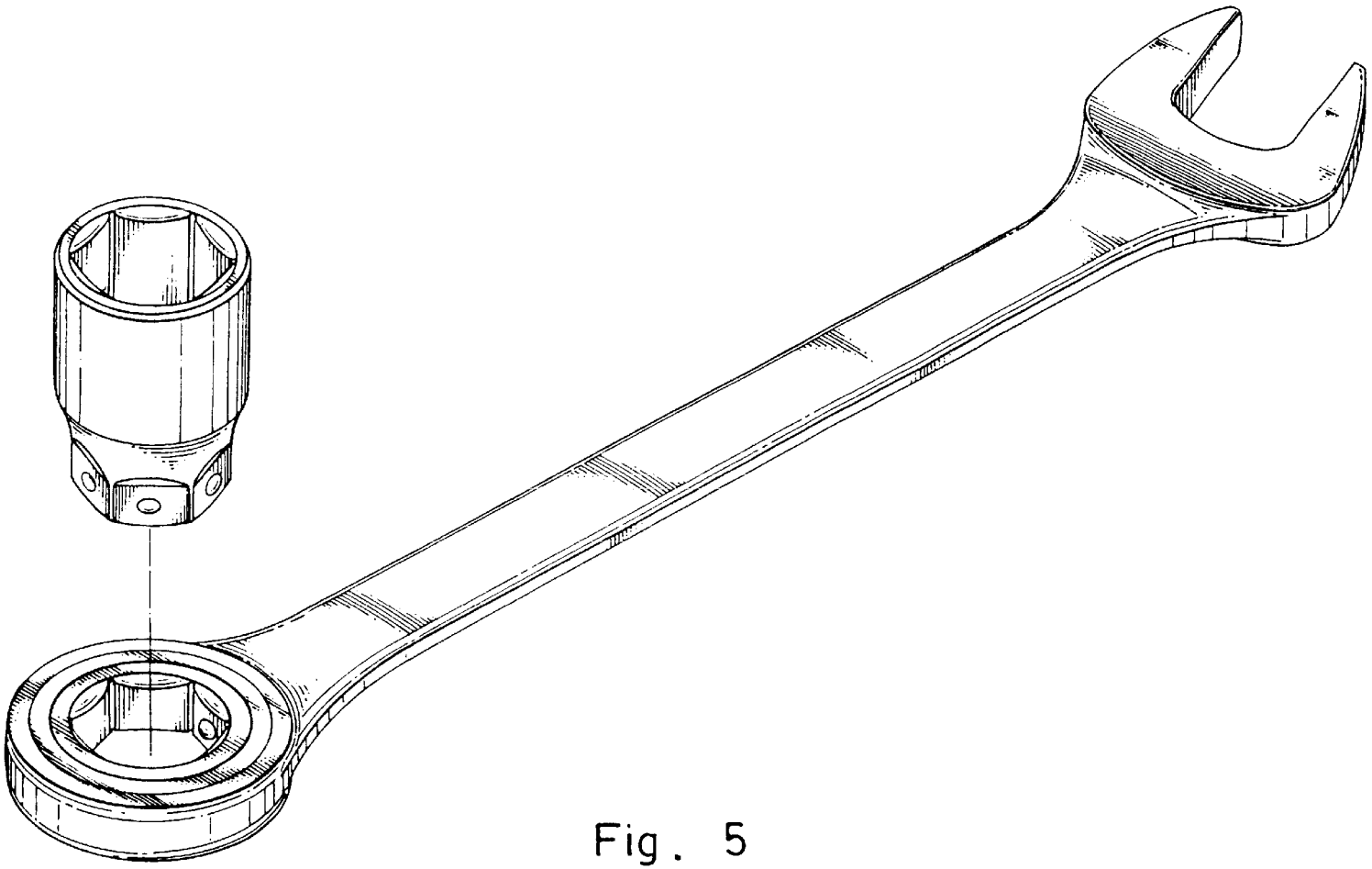
Fig. 5 PRIOR ART
FIG. 5 illustrates a prior art design.

FIG. 4 shows an alternate form of the present invention. This alternate form is similar to the embodiment shown in FIG. 1 with the exception of the retainer means 50. According to this alternate form, the retainer means 50 is comprised of a plurality of smoothly arched resilient wire rods each having a protruded retaining portion 51 respectively inserted through the through holes 232 of the ratchet wheel 20 and partially projecting into the serrated center coupling hole 21 of the ratchet wheel 20.

Figure 3:
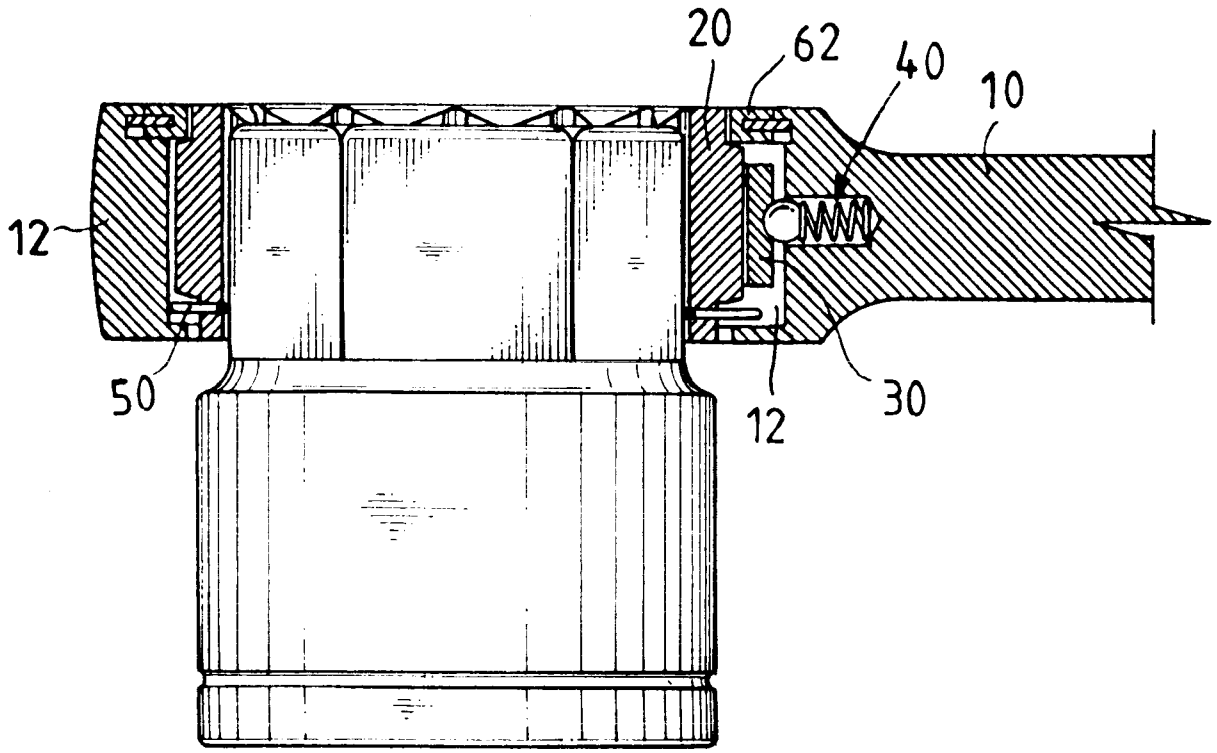
FIG. 3 is a schematic drawing showing an application example of the present invention.

Referring to FIG. 3 again, when a socket is inserted into the serrated center coupling hole 21 of the ratchet wheel 20, the protruded retaining portions 51 of the retainer means 50 are stopped against the periphery of the socket to hold down the socket, enabling the socket to be positively turned with the ratchet 20.

A prototype of box and ratchet wheel arrangement for wrench has been constructed with the features of FIGS. 1~4. The box and ratchet wheel arrangement functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A box and ratchet wheel arrangement comprising:

a wrench body, said wrench body comprising a box at one end thereof, said box comprising a circular receiving open chamber, a recess at one side of said circular receiving open chamber, and a blind hole in said recess;

an annular ratchet wheel mounted in said circular receiving open chamber, said ratchet wheel comprising a serrated center coupling hole adapted to hold a socket, bolt, or nut, and a series of sloping teeth arranged around the periphery thereof and sloping in one direction;

a stop block mounted in said recess of said box of said wrench body and adapted to control the direction of rotation of said ratchet wheel in said box, said stop block having a toothed engagement face adapted to engage the sloping teeth of said ratchet wheel; and a spring member mounted in said blind hole of said box of said wrench body and stopped against said stop block to force said stop block into engagement with the sloping teeth of said ratchet wheel;

wherein said ratchet wheel comprises a protruded portion axially extended from a bottom side thereof, an outside locating groove extended around the periphery of the protruded portion of said ratchet wheel, and a plurality of through holes radially extended through said outside locating groove; retainer means is mounted in the outside locating groove of said ratchet wheel, having protruded retaining portions respectively inserted through the through holes of said ratchet wheel and partially projecting into said serrated center coupling hole for securing a socket, bolt, or nut in said serrated center coupling hole.

2. The box and ratchet wheel arrangement of claim 1 wherein said retainer means is comprised of an annular member of resilient metal mounted in the outside locating groove of the protruded portion of said ratchet wheel, having a plurality of protruded retaining portion respectively inserted through the through holes of said ratchet wheel and partially projecting into the serrated center coupling hole of said ratchet wheel.

3. The box and ratchet wheel arrangement of claim 1 wherein said retainer means is comprised of a plurality of smoothly arched resilient wire rods each having a protruded retaining portion respectively inserted through the through holes of said ratchet wheel and partially projecting into the serrated center coupling hole of said ratchet wheel.

* * * * *